US011933163B1

(12) United States Patent
Al-Mousa

(10) Patent No.: US 11,933,163 B1
(45) Date of Patent: Mar. 19, 2024

(54) LANDING BASE WITH EXTENDED PRESSURE MONITORING COVERAGE

(71) Applicant: Saudi Arabian Oil Company, Dhahran (SA)

(72) Inventor: Ahmed Abdulaziz Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/903,820

(22) Filed: Sep. 6, 2022

(51) Int. Cl.
*E21B 47/117* (2012.01)
*E21B 33/04* (2006.01)
*E21B 47/06* (2012.01)

(52) U.S. Cl.
CPC ..... *E21B 47/06* (2013.01); *E21B 33/04* (2013.01)

(58) Field of Classification Search
CPC ..... E21B 47/06; E21B 47/117; E21B 33/04; E21B 33/047
See application file for complete search history.

(56) References Cited

U.S. PATENT DOCUMENTS 4,458,521 A 7/1984 Pillete
7,357,185 B2 * 4/2008 Walker ..... E21B 33/043 166/344
8,091,648 B2 * 1/2012 Allen ..... E21B 33/0355 166/382
8,220,538 B2 * 7/2012 Wee ..... E21B 33/134 166/387
8,851,184 B2 * 10/2014 Deslierres ..... E21B 34/04 166/373
9,169,709 B2 * 10/2015 Vincent ..... E21B 43/01
9,957,775 B2 * 5/2018 Ferg ..... E21B 23/08
10,161,216 B2 * 12/2018 Samuelson ..... E21B 33/13
10,954,744 B2 * 3/2021 Skeels ..... E21B 43/1185
11,105,196 B2 * 8/2021 Haslanger ..... E21B 47/10
2003/0121653 A1 7/2003 Webster
2013/0226475 A1 8/2013 Franklin

FOREIGN PATENT DOCUMENTS

WO WO 2012027476 3/2012

* cited by examiner

*Primary Examiner* — Kenneth L Thompson
(74) *Attorney, Agent, or Firm* — Fish & Richardson P.C.

(57) ABSTRACT

The present disclosure provides a method for monitoring pressure of fluid inside a wellhead, wherein the wellhead includes a casing spool defining a channel therein, at least one blind flange, and at least one landing base, the method including: deploying a tube along the channel and inside the casing spool, wherein a plurality of shear pins are distributed on the tube; connecting the tube to the at least one blind flange, wherein the at least one blind flange is connected to a pressure gauge; in response to confirming that the pressure of fluid inside the wellhead is to be determined, shearing the plurality of shear pins against the casing spool from inside the channel; and recording, at the pressure gauge, the pressure of fluid inside an annulus between the tube and the casing spool.

20 Claims, 4 Drawing Sheets

LANDING BASE WITH EXTENDED PRESSURE MONITORING COVERAGE

TECHNICAL FIELD

This disclosure generally relates to wellhead maintenance.

BACKGROUND

During oil and gas exploration, wellhead replacement in workover wells and plug and abandon (P&A) operations generally involve cutting the wellhead below landing base/casing housing. Leak detection before cutting the wellhead may involve hot tapping to confirm that the absence of trapped pressure across the cutting depth. Leak detection can involve acoustic detection of potential and actual leaks in pipelines, particularly in subsea valves and wellheads in the oil and gas industry via broadband acoustic emissions sensors.

SUMMARY

In one aspect, the present disclosure describes a method for monitoring pressure of fluid inside a wellhead, wherein the wellhead includes a casing spool defining a channel therein, at least one blind flange, and at least one landing base, the method comprising: deploying a tube along the channel and inside the casing spool, wherein a plurality of shear pins are distributed on the tube; connecting the tube to the at least one blind flange, wherein the at least one blind flange is connected to a pressure gauge; in response to confirming that the pressure of fluid inside the wellhead is to be determined, shearing the plurality of shear pins against the casing spool from inside the channel; and recording, at the pressure gauge, the pressure of fluid inside an annulus between the tube and the casing spool.

Implementations may include one or more of the following features.

The method may further include: extending the tube to below the landing base of the wellhead by up to 5 feet. Recording the pressure may include: recording the pressure of fluid trapped below the landing base. When the plurality of shear pins are sheared against the casing spool, the pressure inside the annulus may be communicated to the at least one blind flange. The method may further include: applying an activating pressure from a control line connected to the casing spool such that the shear pins are sheared. The method may further include: connecting an external pump is to the control line; and activating the external pump such that the activating pressure is applied to shear the shear pins, wherein the activating pressure is instantaneously higher than the pressure of fluid inside the annulus. The control line may be connected to an outlet on the blind flange of the casing spool. The pressure gauge may be located on the external pump. The method may further include: filling the tube with hydraulic oil prior to shearing. The method may further include: in response to determining that the pressure of fluid inside an annulus is within a threshold, cutting the at least one landing base as part of a plug-and-abandon operation. The plug-and-abandon operation may be performed without hot tapping.

In another aspect, the present disclosure describes a wellhead that includes: a casing spool defining a channel therein; at least one blind flange; at least one landing base; and a tube deployed along the channel inside the casing spool and connected to at least one blind flange, wherein a plurality of shear pins are distributed on the tube, and wherein, in response to confirming that a pressure of fluid inside the wellhead is to be determined, the plurality of shear pins are sheared against the casing spool from inside the channel such that the pressure of fluid inside an annulus between the tube and the casing spool is recorded by a pressure gauge.

Implementations may include one or more of the following features.

The tube may be extended to below the landing base of the wellhead by up to 5 feet. The shear pins may be configured such that, when the plurality of shear pins are sheared, the pressure of fluid trapped below the landing base is recorded. The shear pins may be configured such that, when the plurality of shear pins are sheared, the pressure inside the annulus is communicated to the at least one blind flange. The casing spool may be connected to a control line for applying an activating pressure such that the shear pins are sheared. The control line may be connected to an external pump. When the external pump is activated, the activating pressure may be applied to shear the shear pins. The activating pressure may be instantaneously higher than the pressure of fluid inside the annulus. The control line may be connected to an outlet on one of the at least one blind flanges of the casing spool. The pressure gauge may be located on the external pump. The tube may be filled with hydraulic oil. The pressure gauge may be in communication with a computer processor configured to monitor the pressure of fluid inside the wellhead. The tube may be a chrome tube.

Implementations according to the present disclosure may be realized in computer implemented methods, hardware computing systems, and tangible computer readable media. For example, a system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

The details of one or more implementations of the subject matter of this specification are set forth in the description, the claims, and the accompanying drawings. Other features, aspects, and advantages of the subject matter will become apparent from the description, the claims, and the accompanying drawings.

DESCRIPTION OF DRAWINGS

Like reference numbers and designations in the various drawings indicate like elements.

DETAILED DESCRIPTION

The disclosed technology relates to system and method for casing spool and gauges capable of measuring pressure across the circumference of the housing as well as below the landing base flange. The implementations can identify trapped pressure across the circumference or below the cutting depth of landing base to avoid the use of hot tapping equipment. Some implementations may wrap tubes along the inner diameter of a spool with shear pins distributed evenly so as to extend the tubes vertically, for example, 5 ft below the landing base flange (planned cutting point of the wellhead). The shear pins can avoid plugging of the tubes and can be sheared only when required to measure pressure below the landing base. In these implementations, the tubes are connected to the blind flange of the landing base's side outlet to record pressures when a low volume high pressure pump is connected to a control line to apply pressure to shear the pins in the tube. After shearing, the pin holes will be connected to the casing-casing annulus (CCA) to determine if there is pressure across the circumference or below the landing base's flange.

Oil and gas explorations often involve maintaining wellbores at drilling sites. For example, wellhead replacement in workover wells and plug and abandon (P&A) operations may require cutting the wellhead below landing base/casing housing. Hot-tapping is usually required to confirm the absence of trapped pressure across the cutting depth as gauges on casing spool side outlets may not measure pressure below the landing base flange. For example, if the pressure is trapped by cement specially after the cement remedial jobs through casing spool side outlet valve, gauges on casing spool side outlets may be incapable of measuring such pressure. Implementations described by the present disclosure present a design of casing spool and gauges that allow for measuring pressure across the circumference of the housing as well as below the landing base flange.

Figure 1:
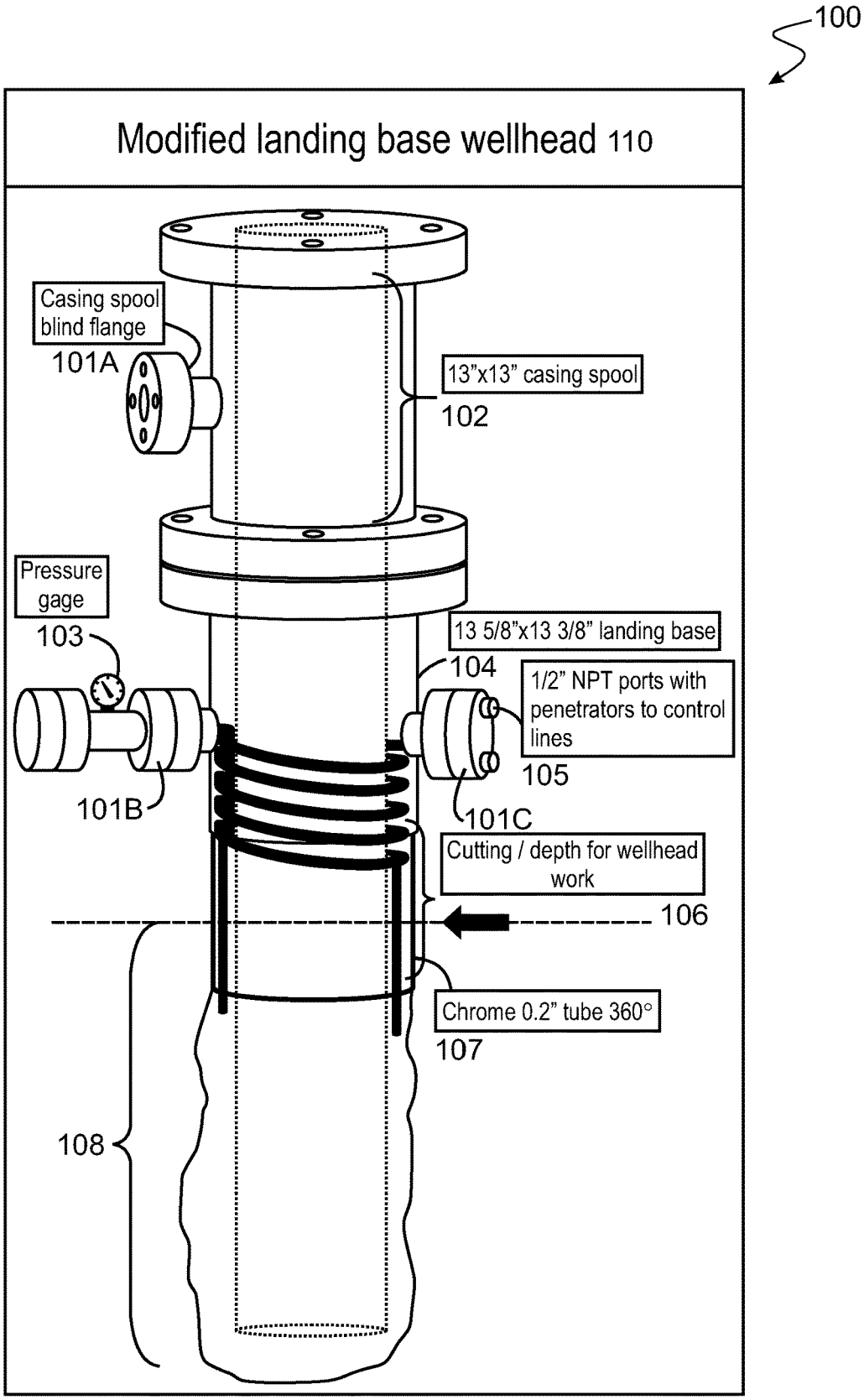
FIG. 1 illustrates an example of a modified landing base wellhead according to some implementations of the present disclosure.

Referring to FIG. 1, diagram 100 illustrates an example of a modified landing base wellhead according to some implementations of the present disclosure. The wellhead includes: casing spool 102, and landing base 104. As illustrated, blind flanges 101A, 101B, and 101C are located on the side of wellhead 110. In one example, blind flange 101B can be mounted with pressure gauge 103 configured to measure pressure inside the casing. In another example, blind flange is fitted with a port 105. In this example, the port includes penetrators to control lines, which, in turn, may connect to an external pump device. The port may be sized as a ½ inch port under the national piper taper (NPT) standard. The external pump device may also have a pressure gauge where pressure can be recorded In some implementations, tube 107 can be a chrome tube (e.g., 0.2" inch in diameter) and wrapped, for example, in a spiral shape, along an inner channel formed by the interior of the casing spool 102. As illustrated, tube 107 can extend into the depth at landing base 104, and beyond depth 106 into segment 108. Tube 107 can be extended, for example, vertically about 5 ft below a flange on the landing base 104, as illustrated in FIG. 1A. In the illustrated example, tube 107 extends to below the cutting point of the wellhead for a plug and abandon (P&A) operation.

Figure 2B:
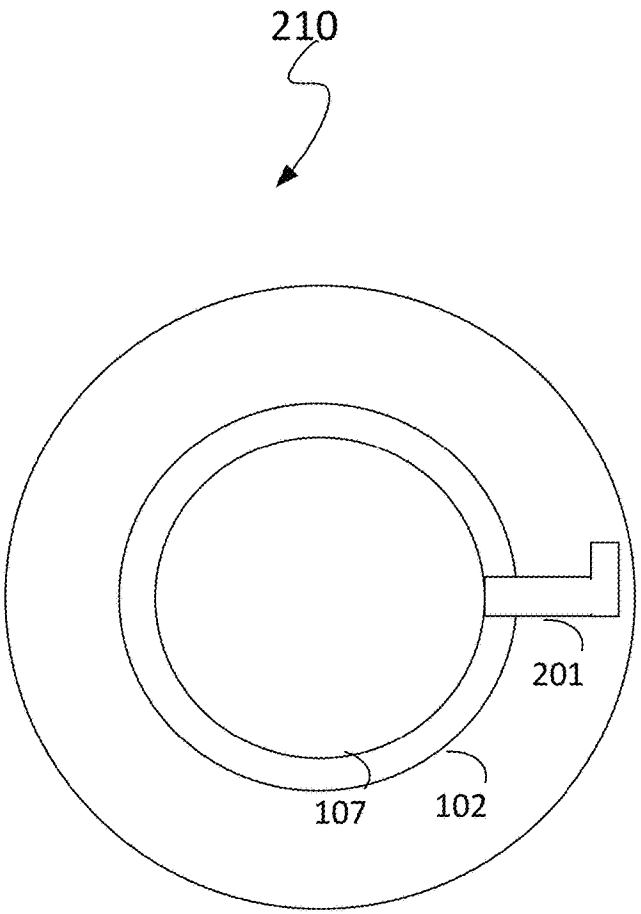
FIGS. 2A and 2B illustrate an example of shearing a shear pin from a resting position to a shearing position according to some implementations of the present disclosure.
Figure 2A:
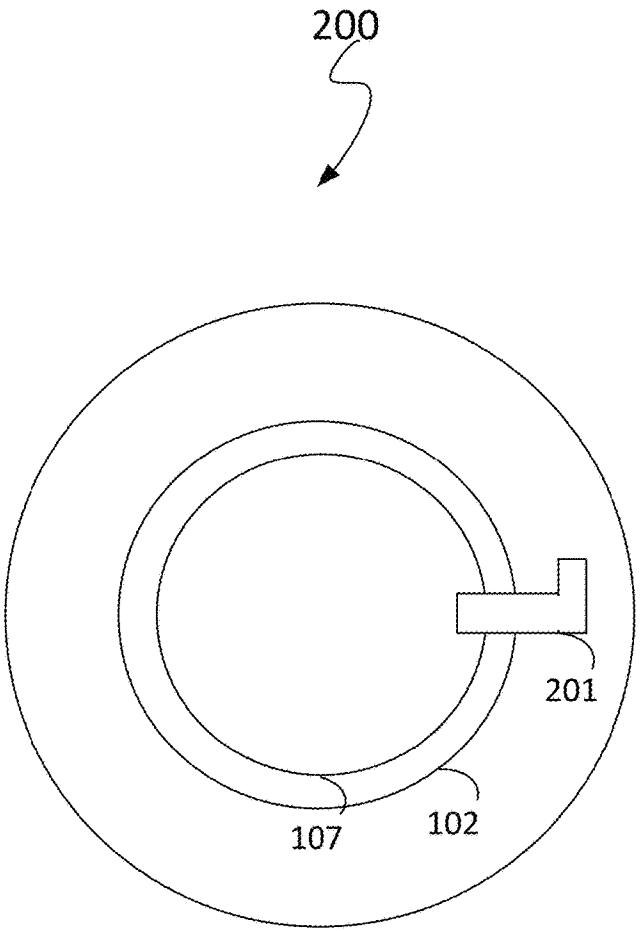

Shear pins can be evenly distributed on tube 107 and inside the inner channel. Further referring to FIG. 2A (showing diagram 200) and 2B (showing diagram 210), shear pin 201 may be positioned on tube 107, which wraps along the inner circumference of casing spool 102. As discussed above, tube 107 may be connected to blind flange 101B where a pressure gauge is installed. Tube 107 may also be connected to blind flange 1010 with of a side outlet sized as a ½" NPT connection to an external pump device where pressure can be recorded. In one example, when pressure recording is required, a low volume high pressure pump is connected to a control line that feed into blind flange 101C to apply an activating pressure that is instantaneously higher than the pressure inside the annulus between the tubing and the casing. Examples include reciprocating pumps with pistons of small cross sectional area that allows pumping small volume of fluids at high pressure. These pumps are generally used in cases requiring injection of small volumes of sealant at high pressures. Indeed, the low volume high pressure pump can pump low volume of fluid into the tube at high pressure. The activating pressure can shear, for example, shear pin from a resting position as illustrated in diagram 200 of FIG. 2A to a sheared position as illustrated in diagram 210 of FIG. 2B, Once the shear pins are sheared, the pressure within the annulus between tube 107 and casing spool 102 can be communicated directly to a blind flange (for example, blind flanges 101A, 101B, and 1010 connected to tube 107). For example, at the time of shearing, a gauge on the low volume high pressure pump that has activated the shearing process can be used to monitor the pressure. As illustrated in FIG. 1A, a ½" NPT connection can be installed on the side outlet of blind flange 1010 for monitoring the pressure in wellhead 110. Additionally or alternatively, pressure gage 103 can be mounted on blind flange 101B to monitor the pressure in wellhead 110. In these configurations, pressure monitoring can last for an extended period.

Figure 3:
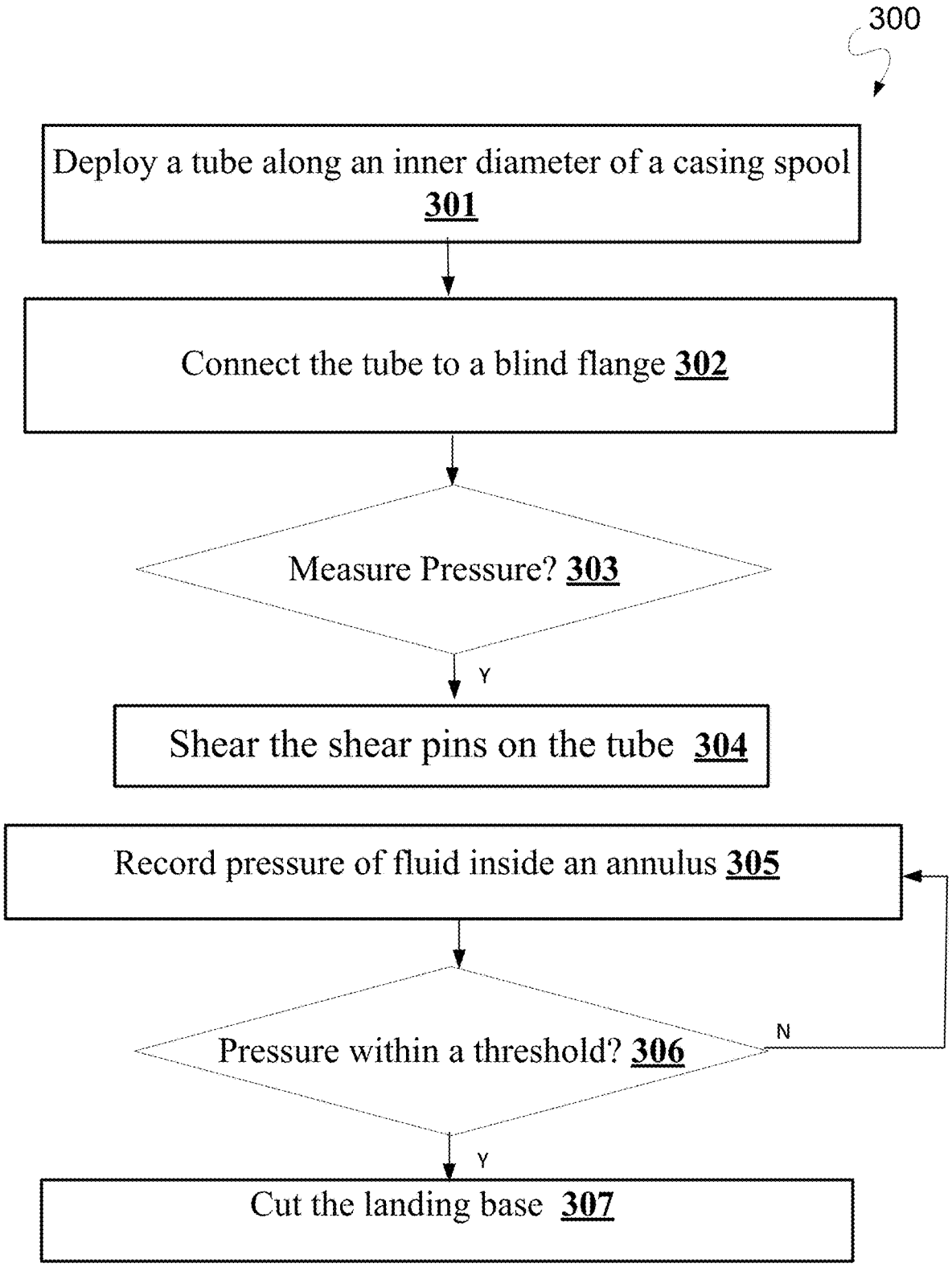
FIG. 3 illustrates an example of a flowchart according to an implementation of the present disclosure.

In various implementations, the shear pins can avoid plugging of tube 107 and can be sheared when pressure below landing base 104 needs to be measured. As illustrated in the transition shown in FIGS. 2A and 2B, the shear pins are constructed to shear against casing spool 102 in response to an instantaneous and high pressure injected from an external pump. The injected high pressure can be, for example, more than twice the expected pressure of fluid inside the casing spool. The shear pins are rated based on the wellhead, which is also rated working pressure. For example, shear pin ratings for 3K, wellheads can be different compared to the 5K wellheads. In general, shear value is less than the wellhead rating. For example, shear pins can be designed to shear at 2200 psi for 3K rated well heads, and can be designed to shear at 4000 psi for 5K rated wellheads. Shear pins are also rated based on casing size and grade. For this reason, shear pins can be configured on a well-to-well basis. Prior to shearing, the tube is filled with hydraulic oil. After shearing, the pin holes may be exposed to the casing-casing annulus (CCA) environment between the tube and the casing spool. Leveraging the sheared pins in this CCA environment, implementations can determine if pressure is trapped, for example, under the landing base, FIG. 3 is a flowchart 300 showing an example of a process according to some implementations for monitoring pressure of fluid inside a wellhead. For example, the wellhead 110 may be scheduled for a plug-and-abandon (P&A) operation, and the operator may need to determine whether residual fluid is trapped inside the wellhead with sufficient pressure to cause disruption. As described above, the wellhead 110 may include a casing spool, at least one blind flange, and at least one landing base. Initially, an operator may deploy a tube inside the casing spool (301). In some cases, the tube is a chrome tube with a diameter of 0.2" inches. The tube may be wrapped to form a spiral along a channel defined by the interior of the casing spool.

The operator may connect the tube to a blind flange (302). For example, the tube may be connected to blind flange where a pressure gauge is installed. Tube may also be connected to blind flange 1010 with of a side outlet sized as a NPT connection to a pressure gauge, which may be located on an external pump. A multitude of shear pins may be located on the tube. The tube may be filled with hydraulic oil before shearing.

When a decision is made to measure pressure below landing base of the wellhead (303), the shear pins on the tube can be sheared (304). As described above, the shear pins are constructed to shear against casing spool in response to an instantaneous and high pressure injected from an external pump connected to, for example, a blind flange of the wellhead. The injected high pressure can be, for example, more than twice the expected pressure of fluid inside the casing spool. After shearing, the pin holes may be exposed to the casing-casing annulus (CCA) environment between the tube and the casing spool.

The process may then record, at the pressure gauge, the pressure of fluid inside an annulus between the tube and the casing spool (305). Once the shear pins are sheared, the pressure of the fluid inside the wellhead is communicated directly to, for example, the side outlet at the blind flange. At the time of shearing, gauge on the external pump (low volume and high pressure) can be sued to monitor pressure of the fluid inside the wellhead. In some cases, an outlet sized as a ½" NPT connection with a pressure gauge can monitor the pressure inside the wellhead for an extended period.

The process may then determine whether the recorded pressure is within a threshold (306). For example, in response to determining that the recorded pressure is within the threshold level, the operator may proceed to cut the landing base (307), for example, at, the intended depth 106 as illustrated in FIG. 1. In response to determining that the recorded pressure is not within the threshold level, the operator may continue monitoring (305) until a later time when the recorded pressure is within the threshold.

Figure 4:
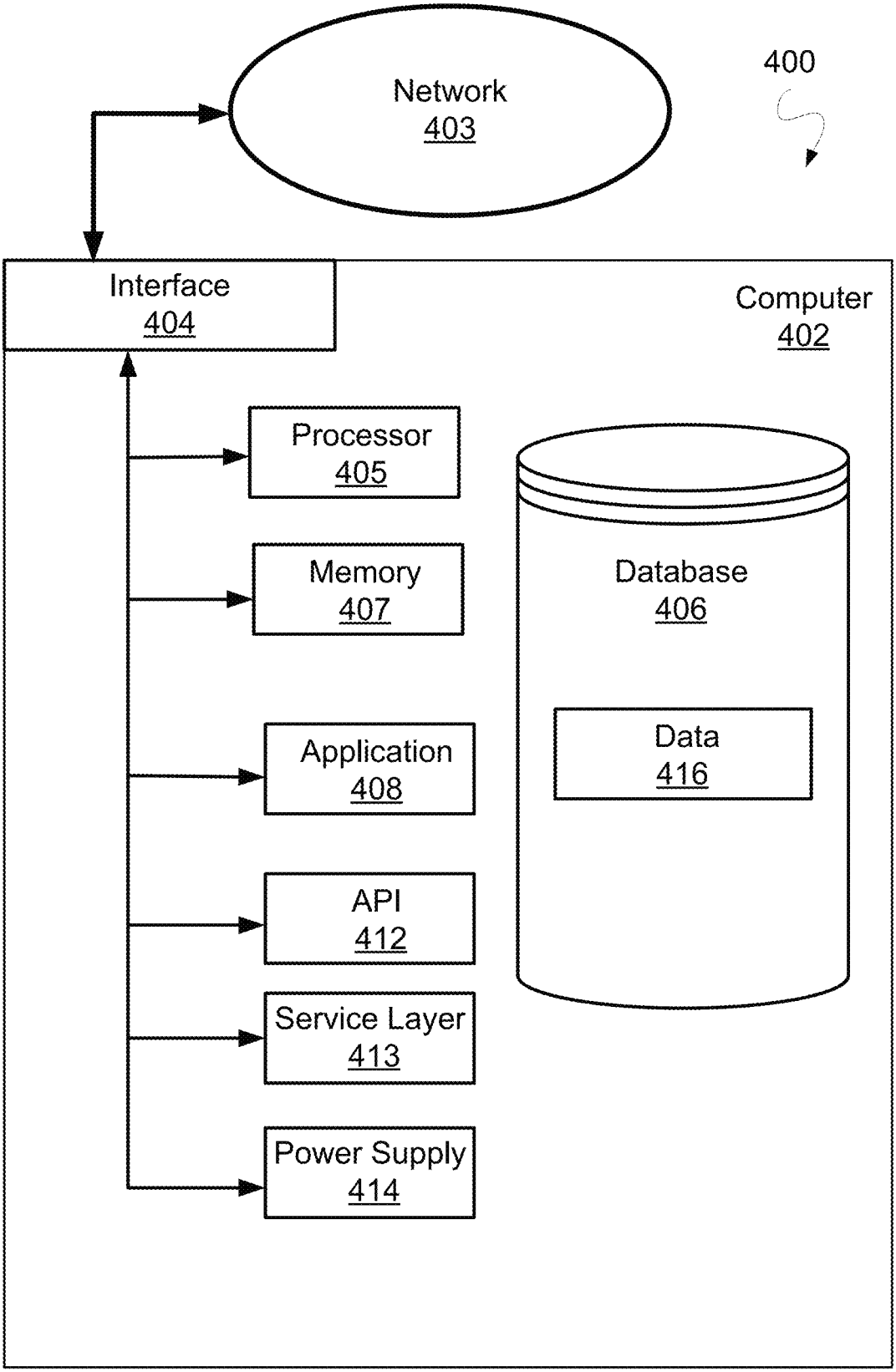
FIG. 4 is a block diagram illustrating an example of a computer system used to provide computational functionalities associated with described algorithms, methods, functions, processes, flows, and procedures, according to an implementation of the present disclosure.

Implementations may be assisted or implemented by a computer system. For example, the process as illustrated in FIG. 3 can be assisted or implemented by a computer system. FIG. 4 is a block diagram illustrating an example of a computer system 400 used to provide computational functionalities associated with described algorithms, methods, functions, processes, flows, and procedures, according to an implementation of the present disclosure. The illustrated computer 402 is intended to encompass any computing device such as a server, desktop computer, laptop/notebook computer, wireless data port, smart phone, personal data assistant (PDA), tablet computing device, one or more processors within these devices, another computing device, or a combination of computing devices, including physical or virtual instances of the computing device, or a combination of physical or virtual instances of the computing device. Additionally, the computer 402 can comprise a computer that includes an input device, such as a keypad, keyboard, touch screen, another input device, or a combination of input devices that can accept user information, and an output device that conveys information associated with the operation of the computer 402, including digital data, visual, audio, another type of information, or a combination of types of information, on a graphical-type user interface (UI) (or GUI) or other UI.

The computer 402 can serve in a role in a computer system as a client, network component, a server, a database or another persistency, another role, or a combination of roles for performing the subject matter described in the present disclosure. The illustrated computer 402 is communicably coupled with a network 403. In some implementations, one or more components of the computer 402 can be configured to operate within an environment, including cloud-computing-based, local, global, another environment, or a combination of environments.

The computer 402 is an electronic computing device operable to receive, transmit, process, store, or manage data and information associated with the described subject matter. According to some implementations, the computer 402 can also include or be communicably coupled with a server, including an application server, e-mail server, web server, caching server, streaming data server, another server, or a combination of servers.

The computer 402 can receive requests over network 403 (for example, from a client software application executing on another computer 402) and respond to the received requests by processing the received requests using a software application or a combination of software applications. In addition, requests can also be sent to the computer 402 from internal users, external or third-parties, or other entities, individuals, systems, or computers.

Each of the components of the computer 402 can communicate using a system bus 403. In some implementations, any or all of the components of the computer 402, including hardware, software, or a combination of hardware and software, can interface over the system bus 403 using an application programming interface (API) 412, a service layer 413, or a combination of the API 412 and service layer 413. The API 412 can include specifications for routines, data structures, and object classes. The API 412 can be either computer-language independent or dependent and refer to a complete interface, a single function, or even a set of APIs. The service layer 413 provides software services to the computer 402 or other components (whether illustrated or not) that are communicably coupled to the computer 402. The functionality of the computer 402 can be accessible for all service consumers using this service layer. Software services, such as those provided by the service layer 413, provide reusable, defined functionalities through a defined interface. For example, the interface can be software written in JAVA, C++, another computing language, or a combination of computing languages providing data in extensible markup language (XML) format, another format, or a combination of formats. While illustrated as an integrated component of the computer 402, alternative implementations can illustrate the API 412 or the service layer 413 as stand-alone components in relation to other components of the computer 402 or other components (whether illustrated or not) that are communicably coupled to the computer 402. Moreover, any or all parts of the API 412 or the service layer 413 can be implemented as a child or a sub-module of another software module, enterprise application, or hardware module without departing from the scope of the present disclosure.

The computer 402 includes an interface 404. Although illustrated as a single interface 404 in FIG. 4, two or more interfaces 404 can be used according to particular needs, desires, or particular implementations of the computer 402. The interface 404 is used by the computer 402 for communicating with another computing system (whether illustrated or not) that is communicatively linked to the network 403 in a distributed environment. Generally, the interface 404 is operable to communicate with the network 403 and comprises logic encoded in software, hardware, or a combination of software and hardware. More specifically, the interface 404 can comprise software supporting one or more communication protocols associated with communications such that the network 403 or interface's hardware is operable to communicate physical signals within and outside of the illustrated computer 402.

The computer 402 includes a processor 405. Although illustrated as a single processor 405 in FIG. 4, two or more processors can be used according to particular needs, desires, or particular implementations of the computer 402. Generally, the processor 405 executes instructions and manipulates data to perform the operations of the computer 402 and any algorithms, methods, functions, processes, flows, and procedures as described in the present disclosure.

The computer 402 also includes a database 406 that can hold data for the computer 402, another component communicatively linked to the network 403 (whether illustrated or not), or a combination of the computer 402 and another component. For example, database 406 can be an in-memory, conventional, or another type of database storing data consistent with the present disclosure. In some implementations, database 406 can be a combination of two or more different database types (for example, a hybrid in-memory and conventional database) according to particular needs, desires, or particular implementations of the computer 402 and the described functionality. Although illustrated as a single database 406 in FIG. 4, two or more databases of similar or differing types can be used according to particular needs, desires, or particular implementations of the computer 402 and the described functionality. While database 406 is illustrated as an integral component of the computer 402, in alternative implementations, database 406 can be external to the computer 402. As illustrated, the database 406 holds the previously described data 416 including, for example, data encoding wellhead positioning, configuration, as well as recorded pressure date from pressure gauge 103.

The computer 402 also includes a memory 407 that can hold data for the computer 402, another component or components communicatively linked to the network 403 (whether illustrated or not), or a combination of the computer 402 and another component. Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 or similar or differing types can be used according to particular needs, desires, or particular implementations of the computer 402 and the described functionality. While memory 407 is illustrated as an integral component of the computer 402, in alternative implementations, memory 407 can be external to the computer 402.

The application 408 is an algorithmic software engine providing functionality according to particular needs, desires, or particular implementations of the computer 402, particularly with respect to functionality described in the present disclosure. For example, application 408 can serve as one or more components, modules, or applications. Further, although illustrated as a single application 408, the application 408 can be implemented as multiple applications 408 on the computer 402. In addition, although illustrated as integral to the computer 402, in alternative implementations, the application 408 can be external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion or management circuits (including recharging, standby, or another power management functionality). In some implementations, the power-supply 414 can include a power plug to allow the computer 402 to be plugged into a wall socket or another power source to, for example, power the computer 402 or recharge a rechargeable battery.

There can be any number of computers 402 associated with, or external to, a computer system containing computer 402, each computer 402 communicating over network 403. Further, the term "client," "user," or other appropriate terminology can be used interchangeably, as appropriate, without departing from the scope of the present disclosure. Moreover, the present disclosure contemplates that many users can use one computer 402, or that one user can use multiple computers 402.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to a receiver apparatus for execution by a data processing apparatus. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be, or further include special purpose logic circuitry, for example, a central processing unit (CPU), an FPGA (field programmable gate array), or an ASIC (application-specific integrated circuit). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with an operating system of some type, for example LINUX, UNIX, WINDOWS, MAC OS, ANDROID, IOS, another operating system, or a combination of operating systems.

A computer program, which can also be referred to or described as a program, software, a software application, a unit, a module, a software module, a script, code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the present disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and apparatus can also be implemented as, special purpose logic circuitry, for example, a CPU, an FPGA, or an ASIC.

Computers for the execution of a computer program can be based on general or special purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device.

Non-transitory computer-readable media for storing computer program instructions and data can include all forms of media and memory devices, magnetic devices, magneto optical disks, and optical memory device. Memory devices include semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Magnetic devices include, for example, tape, cartridges, cassettes, internal/removable disks. Optical memory devices include, for example, digital video disc (DVD), CD-ROM, DVD+/−R, DVD-RAM, DVD-ROM, HD-DVD, and BLURAY, and other optical memory technologies. The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special purpose logic circuitry.

To provide for interaction with a user, implementations of the subject matter described in this specification can be implemented on a computer having a display device, for example, a CRT (cathode ray tube), LCD (liquid crystal display), LED (Light Emitting Diode), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity, a multi-touch screen using capacitive or electric sensing, or another type of touchscreen. Other types of devices can be used to interact with the user. For example, feedback provided to the user can be any form of sensory feedback. Input from the user can be received in any form, including acoustic, speech, or tactile input. In addition, a computer can interact with the user by sending documents to and receiving documents from a client computing device that is used by the user.

The term "graphical user interface," or "GUI," can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with the present disclosure), all or a portion of the Internet, another communication network, or a combination of communication networks. The communication network can communicate with, for example, Internet Protocol (IP) packets, Frame Relay frames, Asynchronous Transfer Mode (ATM) cells, voice, video, data, or other information between networks addresses.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of what can be claimed, but rather as descriptions of features that can be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A method for monitoring pressure of fluid inside a wellhead, wherein the wellhead includes a casing spool defining a channel therein, at least one blind flange, and at least one landing base, the method comprising:

deploying a tube along the channel and inside the casing spool, wherein a plurality of shear pins are distributed on the tube;

connecting the tube to the at least one blind flange, wherein the at least one blind flange is connected to a pressure gauge;

in response to confirming that the pressure of fluid inside the wellhead is to be determined, shearing the plurality of shear pins against the casing spool from inside the channel; and recording, at the pressure gauge, the pressure of fluid inside an annulus between the tube and the casing spool.

2. The method of claim 1, further comprising:

extending the tube to below the landing base of the wellhead by up to 5 feet.

3. The method of claim 2, wherein recording the pressure comprises:

recording the pressure of fluid trapped below the landing base.

4. The method of claim 1, when the plurality of shear pins are sheared against the casing spool, the pressure inside the annulus is communicated to the at least one blind flange.

5. The method of claim 4, further comprising:

applying an activating pressure from a control line connected to the casing spool such that the shear pins are sheared.

6. The method of claim 5, further comprising:

connecting an external pump is to the control line; and activating the external pump such that the activating pressure is applied to shear the shear pins, wherein the activating pressure is instantaneously higher than the pressure of fluid inside the annulus.

7. The method of claim 6, wherein the control line is connected to an outlet on the blind flange of the casing spool, and wherein the pressure gauge is located on the external pump.

8. The method of claim 5, further comprising:

filling the tube with hydraulic oil prior to shearing.

9. The method of claim 1, further comprising:

in response to determining that the pressure of fluid inside an annulus is within a threshold, cutting the at least one landing base as part of a plug-and-abandon operation.

10. The method of claim 9, wherein the plug-and-abandon operation is performed without hot tapping.

11. A wellhead comprising:

a casing spool defining a channel therein;

at least one blind flange;

at least one landing base; and a tube deployed along the channel inside the casing spool and connected to at least one blind flange, wherein a plurality of shear pins are distributed on the tube, and wherein, in response to confirming that a pressure of fluid inside the wellhead is to be determined, the plurality of shear pins are sheared against the casing spool from inside the channel such that the pressure of fluid inside an annulus between the tube and the casing spool is recorded by a pressure gauge.

12. The wellhead of claim 11, wherein the tube is extended to below the landing base of the wellhead by up to 5 feet.

13. The wellhead of claim 12, wherein the shear pins are configured such that, when the plurality of shear pins are sheared, the pressure of fluid trapped below the landing base is recorded.

14. The wellhead of claim 11, wherein the shear pins are configured such that, when the plurality of shear pins are sheared, the pressure inside the annulus is communicated to the at least one blind flange.

15. The wellhead of claim 14, wherein the casing spool is connected to a control line for applying an activating pressure such that the shear pins are sheared.

16. The wellhead of claim 15, wherein the control line is connected to an external pump, and wherein when the external pump is activated, the activating pressure is applied to shear the shear pins, and wherein the activating pressure is instantaneously higher than the pressure of fluid inside the annulus.

17. The wellhead of claim 16, wherein the control line is connected to an outlet on one of the at least one blind flanges of the casing spool, and wherein the pressure gauge is located on the external pump.

18. The wellhead of claim 15, wherein the tube is filled with hydraulic oil.

19. The wellhead of claim 11, wherein the pressure gauge is in communication with a computer processor configured to monitor the pressure of fluid inside the wellhead.

20. The wellhead of claim 11, wherein the tube is a chrome tube.

* * * * *